US005262678A

United States Patent [19]

Flowers et al.

[11] Patent Number: 5,262,678

[45] Date of Patent: Nov. 16, 1993

[54] WALLBOX-MOUNTABLE SWITCH AND DIMMER

[75] Inventors: Woodie C. Flowers, Weston, Mass.; James R. Graybill, Jr., Emmaus, Pa.; Elliot G. Jacoby, Jr., Glenside, Pa.; John E. Longenderfer, Orefield, Pa.; Joel S. Spira, Coopersburg, Pa.

[73] Assignee: Lutron Electronics Co., Inc., Coopersburg, Pa.

[21] Appl. No.: 719,223

[22] Filed: Jun. 21, 1991

[51] Int. Cl.[5] ..... H01C 10/38

[52] U.S. Cl. ..... 307/125; 307/139; 338/176; 338/178; 200/335; 315/295

[58] Field of Search ..... 302/125; 174/53-58; 338/68, 178, 179; 315/297

[56] References Cited

U.S. PATENT DOCUMENTS

| | | | |
|---|---|---|---|
| 4,259,619 | 3/1981 | Wall | 315/361 |
| 4,520,306 | 5/1985 | Kirby | 323/324 |
| 4,564,801 | 1/1986 | Kirby | 323/324 |
| 4,575,660 | 3/1986 | Zaharchuk | 315/295 |
| 4,695,820 | 7/1990 | Tucker et al. | 807/139 |
| 4,939,383 | 9/1987 | D'Aleo et al. | 338/179 |

OTHER PUBLICATIONS

Lutron Lighting Controls-Condensed Catalog 1990, pp. 10-21.

*Primary Examiner*—A. D. Pellinen
*Assistant Examiner*—Aditya Krishnan
*Attorney, Agent, or Firm*—Seidel, Gonda, Lavorgna & Monaco

[57] ABSTRACT

A wallbox-mountable system for controlling electrical power to a load is disclosed. The system comprises a yoke, a frame, a toggle switch and at least one slidable lever. The yoke has an opening which is completely occupied by the frame member and the frame member has at least one channel. The toggle switch has a handle extending through the frame and has one end mechanically coupled to a means for turning power on and off to a load. The slidable lever extends through the channel and is mechanically coupled to a means for adjusting the power to a load.

47 Claims, 7 Drawing Sheets

WALLBOX-MOUNTABLE SWITCH AND DIMMER

FIELD OF THE INVENTION

This invention relates to a switch/dimmer assembly that provides for both ON-OFF switching and dimming control for electrical power applied to a load. In an alternative embodiment, the invention provides for both three-way switching and dimming control for electrical power to a load such as a lamp.

DESCRIPTION OF THE RELATED ART

Light dimmers having ON-OFF switching capabilities are well-known and one such dimmer is described in U.S. Pat. No. 4,259,619 of Wall issued Mar. 31, 1981. The '619 patent discloses a dimmer switch having a single actuator with FULL, DIM, and OFF positions for controlling the brightness of lamps. The FULL position turns the lights ON at full brightness, whereas, the OFF position turns the lights OFF. The DIM position has a range of movement that is responded to by a dimming circuit to control the brightness of a lamp. In practice, it is desired that the dimming of the lamp have a preset condition that remains undisturbed. The single actuator of the '619 patent does not provide for the ability to separately control the ON-OFF state of the lamp while at the same time allowing the preset dimmer condition of the lamp to remain undisturbed.

U.S. Pat. Nos. 4,520,306 and 4,564,801 both of Kirby, respectively issued May 28, 1985 and Jan. 14, 1986, both disclose a single dimmer switch having a rotatable shaft for dimming a load and wherein the shaft is depressible to accomplish the ON-OFF switching of the load.

A switch assembly mounted in a wallbox is disclosed in U.S. patent application Ser. No. 07/225,457 of Rowen et al. filed Jul. 28, 1988, assigned to the assignee of the present invention, and is herein incorporated by reference. U.S. application Ser. No. 07/225,457 discloses an assembly having a short throw light force switch for controlling ON-OFF switching and a linear slide control for dimming. The relative size of the push button switch predominates over the size of a linear dimmer slider which is advantageous from human factor considerations. Although the wall-mountable switch and dimmer of Ser. No. 07/225,457 serves well its intended purpose, further improvements to the assembly can be made to adapt it for use with standard toggle switch faceplate openings.

Accordingly, it is an object of the present invention to provide a wall-mountable dimmer switch assembly having an arrangement that is particularly suited to provide control of both the ON-OFF and dimming functions for a load.

It is a further object of the present invention to provide for a dimmer assembly that controls the ON-OFF switching while at the same time does not disturb a preset dimming condition for the lamp.

SUMMARY OF THE INVENTION

The present invention is directed to a dimmer switch assembly that may be arranged to provide for control of both the ON-OFF switching and dimming of a lamp.

In one embodiment, a wallbox-mountable system for controlling electrical power to a load comprises a yoke having an opening located in correspondence with a central opening of a wallbox faceplate, a toggle switch, and at least one movable lever. It is preferred that a frame member be also included in the system. The toggle switch and movable lever are located in a side-by-side arrangement with the toggle switch and movable lever moving in a vertical direction. The yoke has an opening corresponding to a standard opening of the faceplate and which is completely occupied by the frame member having at least one channel. The toggle switch includes a handle having one end extending through the opening and the other end of its handle mechanically coupled to means for turning power ON and OFF to the load. The movable lever extends through and is movable within the opening of the yoke and has one end for holding that extends out of the channel and its other end mechanically coupled to means for adjusting the amount of power supplied to the load.

In another embodiment, the wallbox-mountable system has two movable levers, one on each side of the toggle switch.

In a further embodiment, a wallbox-mountable system, particularly suited for energy-management applications, the movable lever does not pass through the frame, rather, the channel of the frame provides a passageway for inserting a tool to adjust the movable lever, and hence, the amount of power supplied to the load.

In a further embodiment the channel of the frame has a removable plug to prevent access to the movable lever when the plug is inserted.

Other objects, advantages and novel features of the present will become apparent from the following detailed description of the invention when considered in conjunction with the accompanying drawings.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

The present invention provides a switch and dimmer assembly that is particularly suited for accomplishing both ON-OFF switching and dimming for electrical loads such as lamps.

Figure 1:
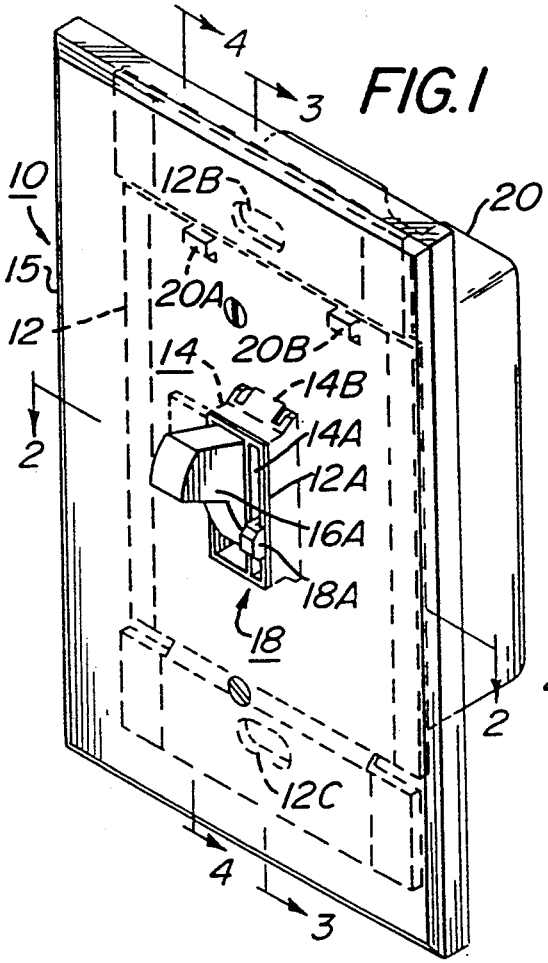
FIG. 1 is an isometric view of one embodiment of the wallbox-mountable switch of the present invention.

One embodiment of the present invention is depicted in FIG. 1, which is an isometric view of a switch and dimmer assembly 10. The assembly 10 may be of a wall-box-mountable type comprising a yoke 12, a toggle switch 16 having a handle 16A, a dimmer control 18 having a slidable arm with a member 18A for holding and adjusting and a backcover 20 for housing the elements that are interconnected to the toggle and dimmer switches 16 and 18, respectively, as well as the circuit elements to accomplish the dimming function. In practice, the yoke 12 is preferably covered by a wallbox faceplate 15. It is preferred that the assembly 10 also include a frame 14.

The yoke 12 has openings 12B and 12C which are used for connecting the yoke 12 to a standard wallbox housing (not shown). The yoke 12 has a central opening 12A. The central opening 12A has dimensions essentially corresponding to that of a standard type opening of the faceplate 15 which is of a rectangular shape and has dimensions of about 25 mm in height and about 12 mm in width. In one embodiment, the opening 12A is completely occupied by the toggle switch and a slidable arm in a side-by-side arrangement. In another embodiment, the opening 12A is completely occupied by the toggle switch and two separate slidable arms also in a side-by-side arrangement. It is preferred that the toggle switch is substantially wider than the slidable arm or arms as in use the toggle switch will typically be adjusted much more frequently than the slidable arm or arms.

The toggle switch 16 can be operated by grasping the handle 16A with a thumb and forefinger or by flicking it up and down with just a forefinger. Hence, its operation is identical to that of a conventional general purpose toggle switch. This is particularly advantageous where the switch and dimmer assembly of the present invention is mounted in a multigang wallbox with conventional toggle switches as all the devices will operate in a similar manner.

The frame 14 has clamping arms 14B at opposite ends for engaging and affixing to opening 12A. Frame member 14 is sized to fit within a standard NEMA toggle switch opening which is defined by *NEMA Standards Publication/No. WD* 1-1979 on page 8 as having dimensions 0.925 (minimum) inches high by 0.406 inches wide. The frame member 14 completely occupies the opening 12A and has a channel 14A in which the arm 18 is slidable and from out of its frontal portion that the member 18A extends.

As shown in FIG. 1, the switch handle 16A and the channel 14A, having the member 18A, essentially and completely occupy the frontal portion of the frame 14. For another embodiment, devoid of frame 14, the toggle switch 16 and lever arm 18 are spaced apart from each other by a sufficient amount to avoid any interference in their respective movement while at the same time allowing both elements to snugly fit within opening 12A.

The toggle switch 16 of all embodiments uses an over-center spring bistable mechanism, to be further discussed with reference to FIG. 4, which functions such that during operation when movement of the handle passes the center position of the switch, a spring mechanism further assists the movement to reach the up (ON) or down (OFF) position. This type mechanism has a distinct tactile feel that notifies an operator when the desired switching is performed.

The slidable dimmer actuator 18 is preferably of the linear type in which the slider moves linearly along a predetermined path. This type is beneficial in that it permits lighting levels to be determined easily from its slider position which determination is particularly advantageous when the slidable control and lights being controlled are not visible from the control location. The slidable control 18 is preferably used to operate a linear potentiometer 22 housed within backcover 20.

The backcover 20 is affixed to yoke 12 by means of snap-fitting projections 20A and 20B and an attachment screw (not shown). The backcover 20 houses the mechanical coupling or interconnection of toggle switch 16 and microswitch 24, actuator 18 that cooperates with potentiometer 22, the dimmer circuitry, and other devices related to the present invention. The interconnection of control arm 18 to a potentiometer 22 that is used to adjust power to a load, as well as the interconnection of the handle 16A to means for turning power ON and OFF to a load, may be described with reference to FIG. 2 which is a view taken along line 2—2 of FIG. 1.

Figure 2:
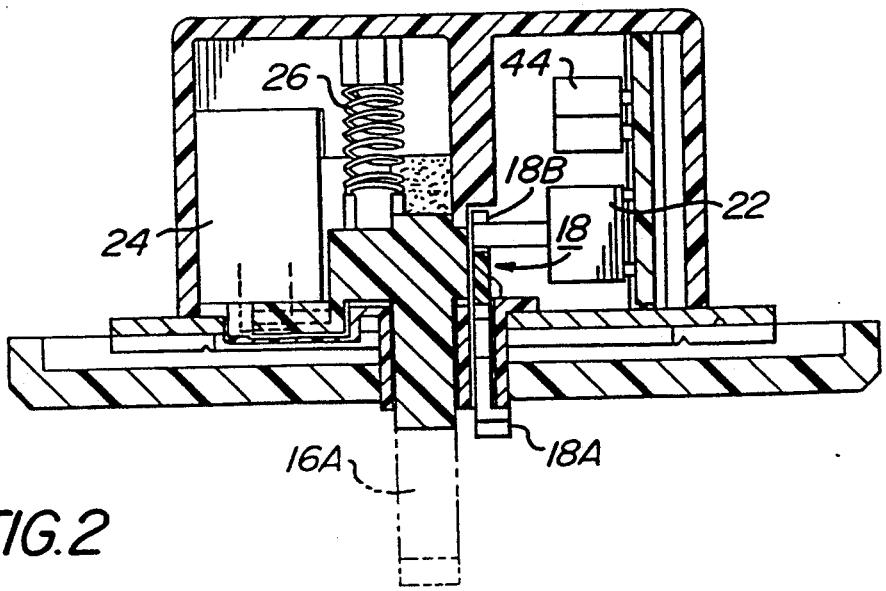
FIG. 2 is a view taken along line 2—2 of FIG. 1 showing the assembly of the toggle switch and slidable dimmer of the present invention.

FIG. 2 shows the arm 18 as being interconnected by bar member 18B to the means for adjusting the power to the load e.g., linear potentiometer 22. FIG. 2 further shows the handle 16A as being interconnected to the ON-OFF switching means, e.g., microswitch 24. The interconnection of member 18B to potentiometer 22 is further illustrated in FIG. 3 which is a view taken along line 3—3 of FIG. 1.

Figure 3:
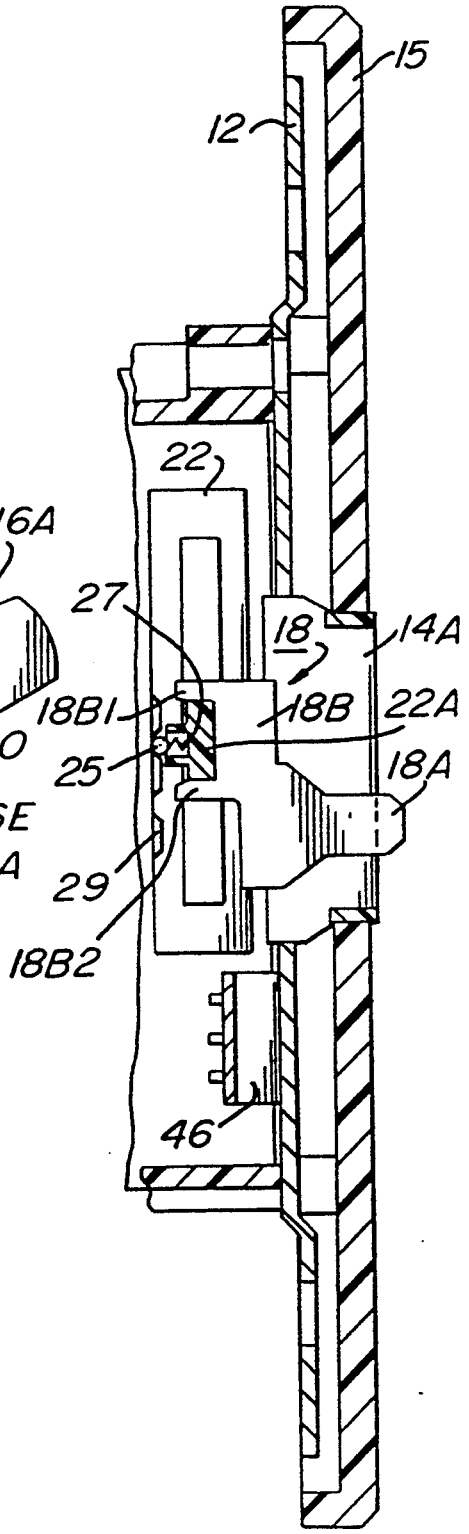
FIG. 3 is a view taken along line 3—3 of FIG. 1 showing details of the slidable lever of the present invention.

FIG. 3 shows bar member 18B as having outer portions 18B1 and 18B2 that are each positioned at and capture opposite sides of movable member 22A of the linear potentiometer 22. The movement of member 18A along a linear path within channel 14A correspondingly causes the movement of member 22A which, in turn, causes a corresponding increase or decrease in the variable resistance of potentiometer 22. The movement of toggle switch 16 which is of importance to the present invention may be described with reference to FIG. 4 which is a view taken along line 4—4 of FIG. 1.

Figure 4:
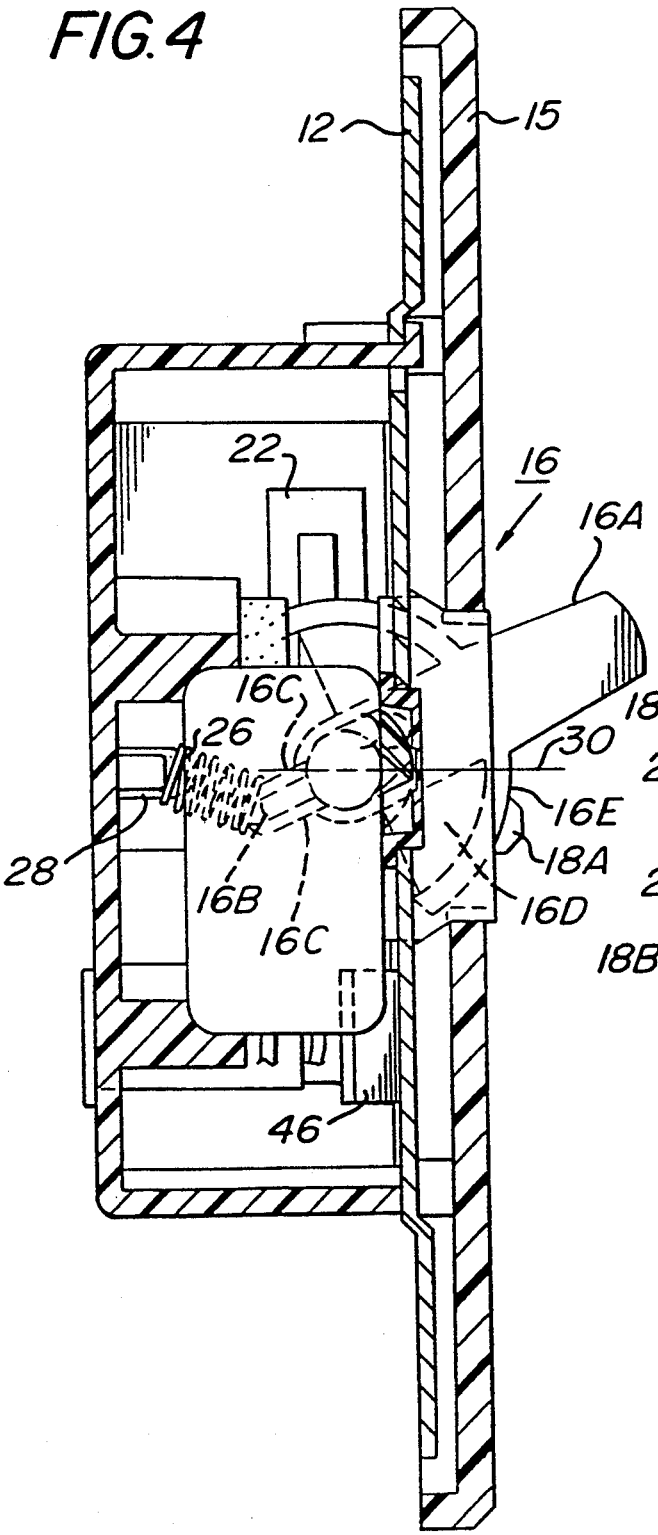
FIG. 4 is a view taken along line 4—4 of FIG. 1 showing details of the mechanical coupling of the toggle switch to a microswitch.

FIG. 4 shows the handle 16A as interconnected to a rearwardly projecting portion 16B having rail portions 16C each of which mates with one end of the previously mentioned over-center spring 26 which has its other end mating with retaining means 28 that is affixed to the backcover 20. The handle 16A and rear portion 16B are blended together by a central portion 16D of toggle switch 16 having an outer arc-like shaped portion 16E. The toggle 16 rotates about a centerline 30 shown in FIG. 4.

In operation, as handle 16A is moved so as to rotate about centerline 30, the rails 16C engage spring 28, and when the central region of the handle 16A approaches the centerline 30, the spring imparts a force to the rails 16C which assists in the further movement of handle 16A to its fully up (ON) or fully down (OFF) position. The ON and OFF positions control the operation of the microswitch 24 and may be described with reference to FIG. 5.

Figure 5:
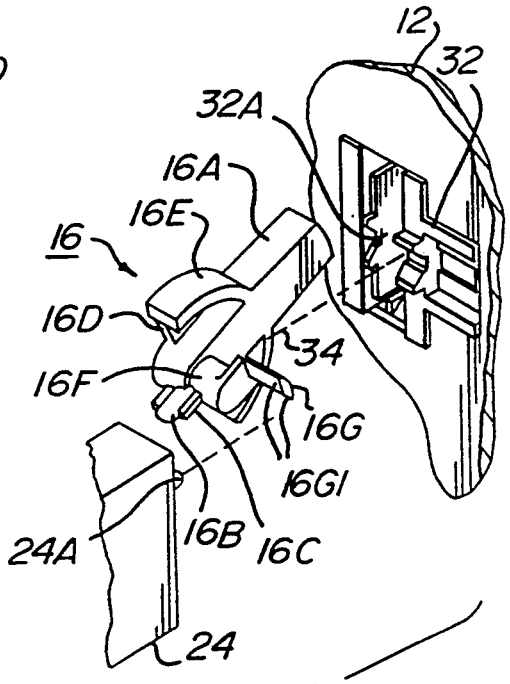
FIG. 5 shows further details of the interconnection of the toggle switch to the microswitch and the yoke of the wallbox-mountable switch.

FIG. 5, shown partially in section, is an exploded perspective view illustrating the toggle 16 spaced apart from the microswitch 24 and a cradle 32. The cradle 32 is affixed to the yoke 12 and has a central region 32A having dimensions that are complementary to an axial portion 16F of the toggle 16. The axial portion 16F is mated with the central region 32A along line 34 shown in FIG. 5. The cradle 32 provide the means for housing toggle switch 16 to the yoke 12.

The toggle handle 16, more particularly, an extension member 16G mates with the microswitch 24 along line 36 shown in FIG. 5. The member 16G has inwardly curved portions 16G1 located on toggle switch 16 in a predetermined manner so as to mate with actuator 24A of microswitch 24 when the toggle switch 16 is moved to its ON or OFF position. The actuator 24A controls the switching of the microswitch 24.

Figure 6:
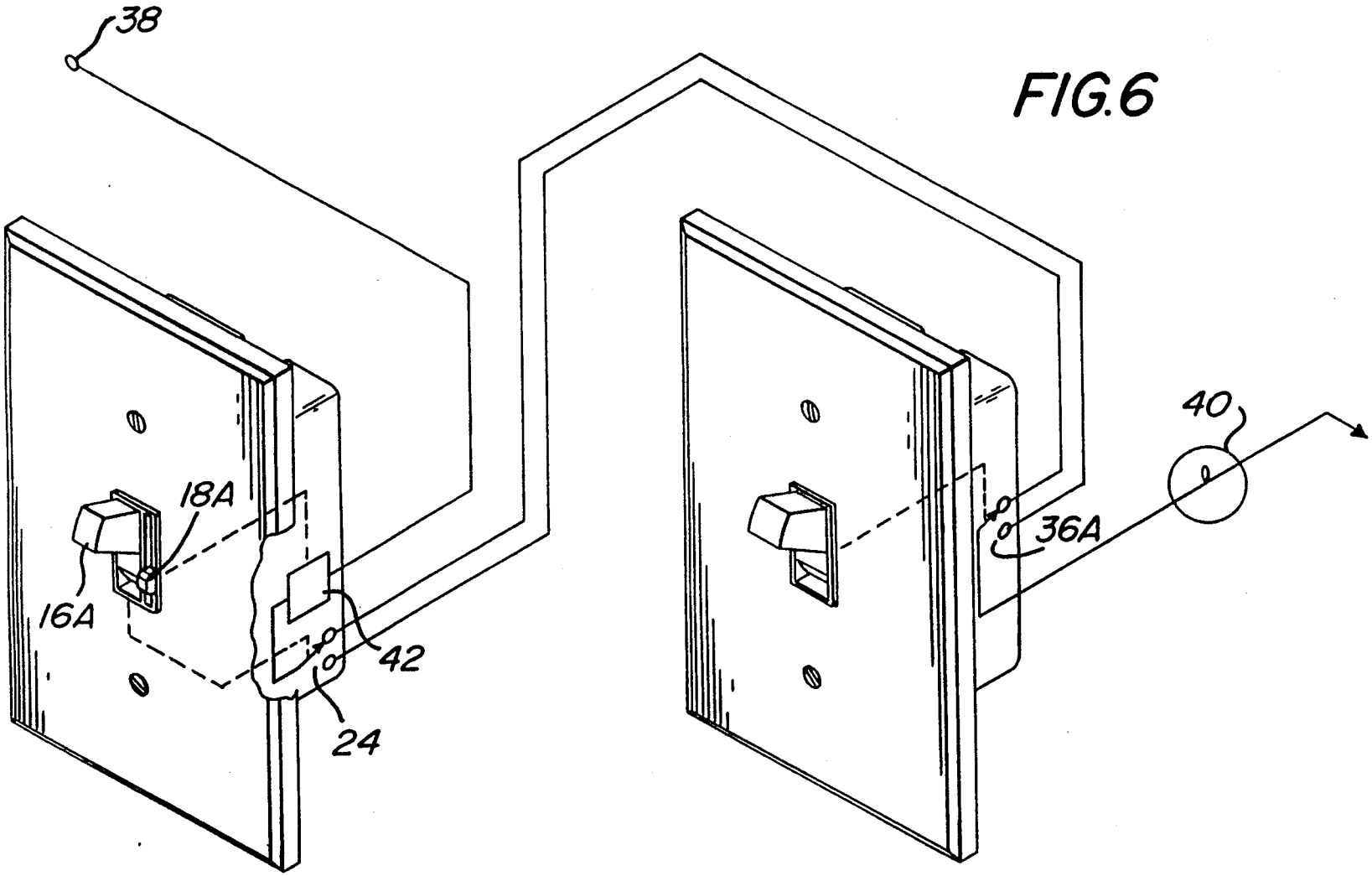
FIG. 6 is a functional representation of an arrangement of particular importance to the present invention to accomplish both three-way ON-OFF switching and dimming.

A primary feature of the present invention is to provide for independent three-way ON-OFF switching and dimming control from a toggle switch type of dimmer comprising the assembly 10. FIG. 6 illustrates an assembly 10 providing station A and a standard three-way switch 36, having contacts 36A, providing station B. Each of the stations A and B controls (ON-OFF) the excitation 38 supplied to a lamp 40. The assembly 10 of station A further includes dimmer circuit 42 for adjusting the amount of power applied to the load 40. The dimmer circuit 42 comprises various components some of which 44 and 46 are respectively shown in FIGS. 3 and 4. The dimmer circuit 42 may be that disclosed in the RCA Thyristor and Rectifier Manual, published in 1975 on page 229 which is herein incorporated by reference.

In operation, the amount of power supplied to the load 40 may be controlled by station A. Further, each station A or B has the ability to separately and independently control the ON-OFF state of the load 40.

The switching described with reference to FIG. 6 may also be obtained by the arrangement of the wall-box-mountable switch of the previously mentioned U.S. patent application Ser. No. 225,457; however, not with the same benefits of the present invention. The primary difference between the Ser. No. 225,457 and the present invention being the toggle switch 16.

The practice of the present invention further provides for means that prevent the inadvertent movement of the dimming control 18 during the operation of the toggle switch 16 and which may be described with reference to one embodiment shown in FIG. 7.

Figure 7:
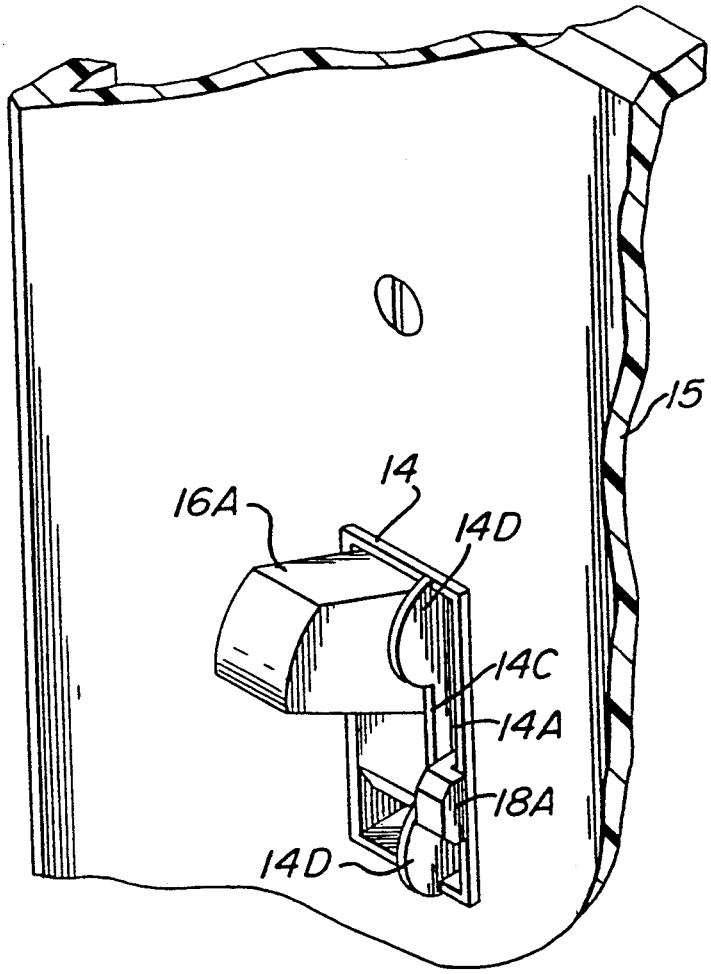
FIG. 7 is an embodiment of the present invention that prevents the inadvertent movement of the linear dimmer switch of the present invention.

FIG. 7 is partially in section showing the face-plate 15 enlarged relative to FIG. 1. FIG. 7 shows a frame 14 in which the channel 14A is partially formed by a wall having a top surface 14C adjacent to but not interfering with the path of travel of member 18A. The top surface 14C has at least one protuberance 14D, but preferably two located at opposite ends of the path of travel of member 18A. The protuberances 14D have a height dimension that exceed the height of the member 18A. The protuberances or bumps 14D are located in the upper and lower regions in which the switch handle 16A is likely to be contacted during its operation which, in turn, may inadvertently cause the handle 18A to be moved during such operation. The protuberances 14D serve as means to safeguard the preset condition of the dimming control during the operation of toggle handle 16A.

A further embodiment of the present invention that prevents inadvertent movement of the lever arm 18 includes detents 29 on the linear potentiometer to inhibit inadvertent movement. The detents 29 may be placed along the path of movement and the arm may have ball-like member 25 that cooperates via spring means 27 with the detents 29 so as to only allow intentional movement of the arm.

Figure 8:
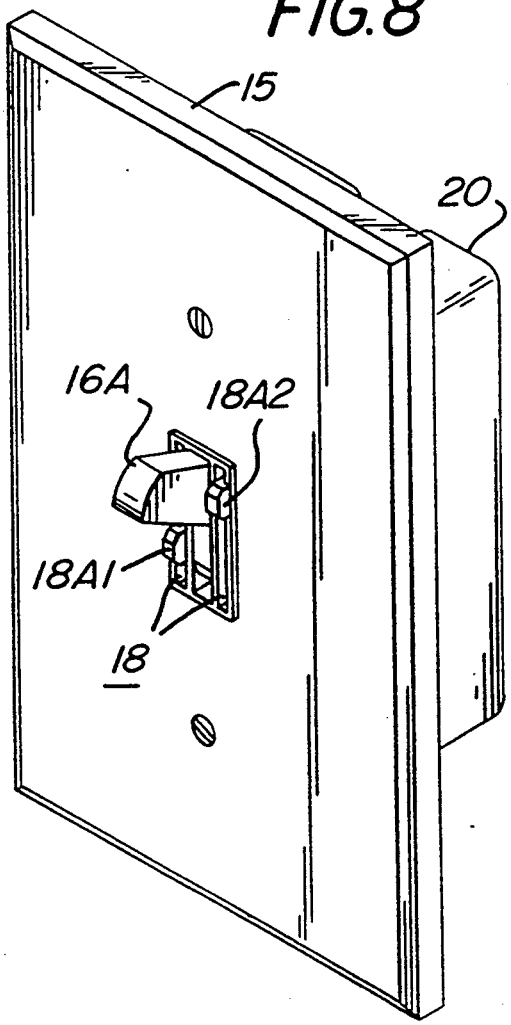
FIG. 8 is an isometric view of a wallbox-mountable switch of the present invention having dual means for adjusting power to electrical loads.

Another embodiment of the present invention is illustrated in FIG. 8 which is similar to FIG. 1 except for its showing of members 18A1 and 18A2 that are advantageously used for various control means. In one embodiment envisioned by the present invention, the control member 18A1 may be used for adjusting the intensity level of lamps within a room, such as a bathroom, whereas, the other control member 18A2 may be used to control the speed of the motor of a fan within such a bathroom.

The control members 18AI and 18A2 may be used to preset the illumination level and speed, respectively, and these preset illumination and speed positions are activated or deactivated by the movement of switch handle 16A to its ON or OFF position. Control members 18A1 and 18A2 can control potentiometers, or control member 18A1 can control a potentiometer, and control member 18A2 can control a multiposition switch used for motor speed control applications.

Figure 13:
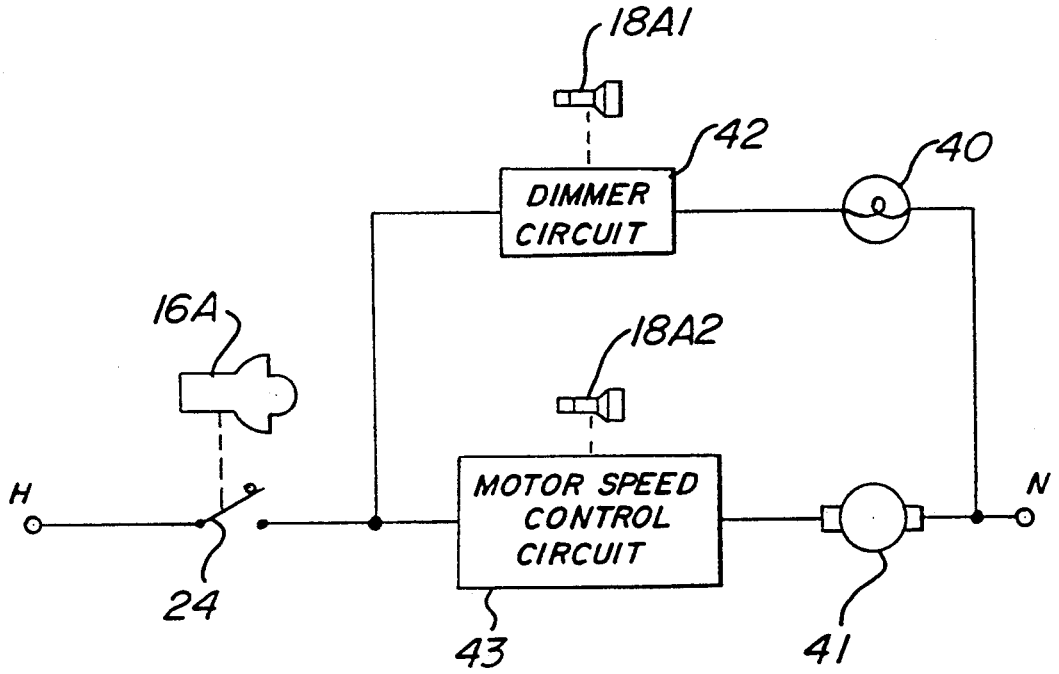
FIG. 13 is a circuit block diagram of a circuit which can be used with the switch and dual adjusting means of FIG. 8.

As is further illustrated in FIG. 13, switch handle 16A operates switch 24 which connect both dimmer circuit 42 and motor speed control circuit 43 to the hot terminal (H) of the supply when switch 24 is in the ON position.

Dimmer circuit 42 controlling lamp 40 may be that disclosed in the *RCA Thyristor and Rectifier Manual*, published in 1975, on page 229 which is herein incorporated by reference, and control member 18A1 controls the potentiometer within that circuit. Motor speed control circuit 43 controlling motor 41 may be that disclosed in the *RCA Thyristor and Rectifier Manual*, published in 1975, on page 238 which is herein incorporated by reference and control member 18A2 controls the potentiometer within that circuit.

Alternatively, motor speed control circuit 43 may be that disclosed in copending application Ser. No. 07/478,604, filed Feb. 12th, 1990, herein incorporated by reference and control member 18A2 controls the multiposition switch within that circuit.

Figure 9:
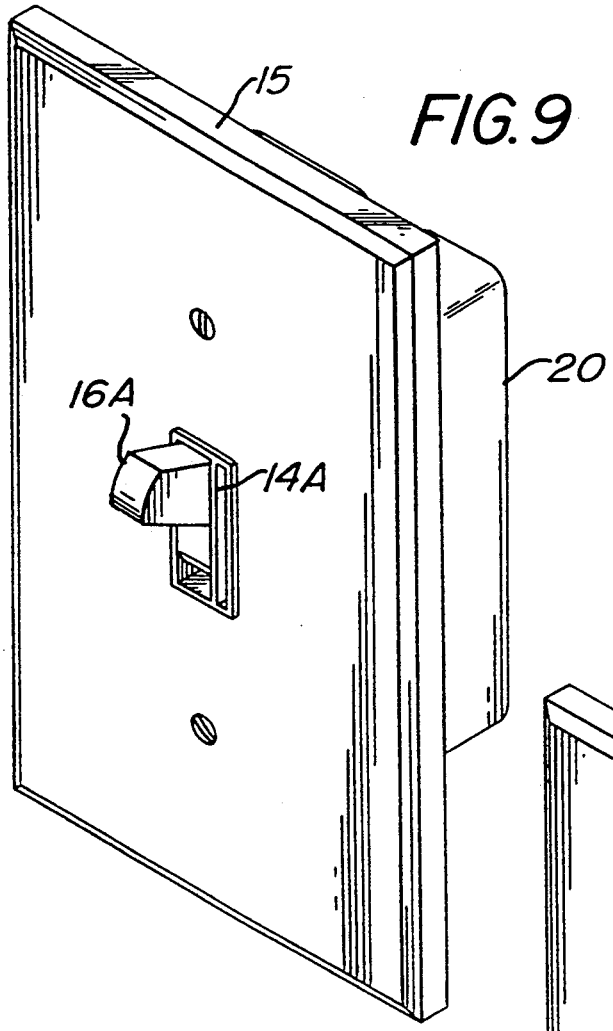
FIG. 9 is still a further embodiment of a wallbox-mountable switch that is particularly suited for energy-management applications.

A further embodiment related to the present invention that is particularly suited for energy management considerations is illustrated in FIG. 9. The frame 14 has provided therein a channel 14A, previously discussed with regard to FIG. 1, that has a sliding member 18A which does not extend out of channel 14A. Channel 14A provides a passageway for the insertion of a tool to set sliding member 18A, and hence, the means for adjusting power to a load to a particular position so that the power applied to a load, such as lamp 40 of FIG. 6, remains fixed at the preset position, but responsive to the ON/OFF control provided by handle 16A, and can only be further adjusted by the use of a tool.

Figure 10:
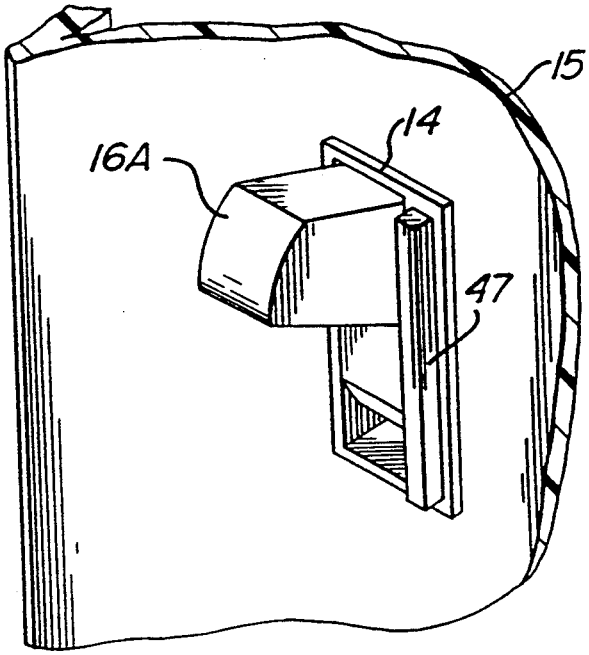
FIG. 10 is another embodiment particularly suited for energy-management applications.

Another embodiment is shown in FIG. 10 which is similar to FIG. 9 except for the showing of the frame 14 in an enlarged manner and for faceplate 15 partially in section. The embodiment of FIG. 10 also finds use for energy management applications. FIG. 10 shows a removable plug 47 which prevents access to the slidable arm 18. In operation, the plug 47 is removed and the lever arm is adjusted to a desired preset position and then plug 47 is replaced. This helps to ensure that slidable arm 18 remains at the preset position.

Figure 11A:
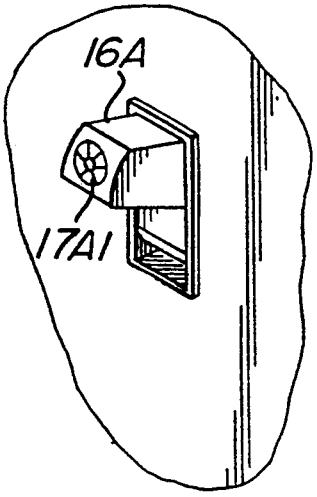
FIGS. 11*a*, 11*b* and 11*c* show embodiments of the invention that use rotatable dimmer actuators.
Figure 11B:
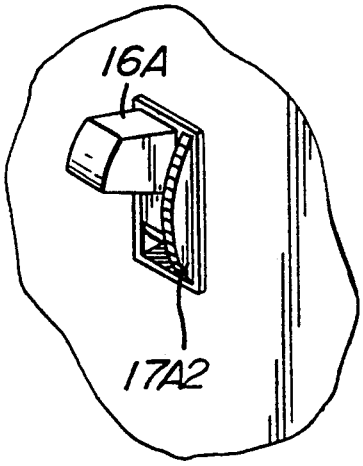
Figure 11C:
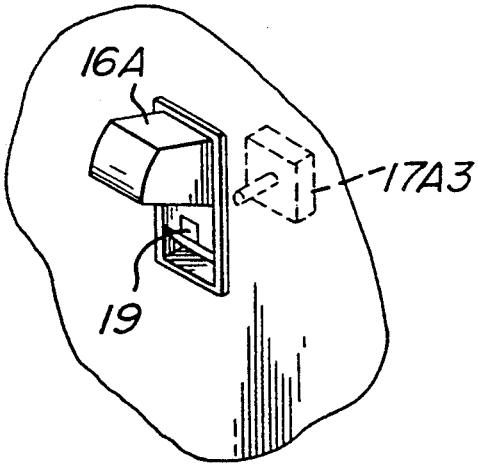

Further embodiments of the invention are shown in FIGS. 11*a*, 11*b* and 11*c*. Each of these embodiments include switch handle 16A of FIG. 1 to control the ON/OFF switching of the load. However sliding member 18A has been replaced with rotatable members 17A1, 17A2, and 17A3 respectively shown in FIGS. 11*a*, 11*b* and 11*c*.

FIG. 11*a* shows rotatable member 17A1 located on the end of handle 16A. The rotatable member 17A1 is coupled to a rotary potentiometer by a flexible coupling (not shown). Adjustment of rotatable member 17A1 varies the setting of the rotary potentiometer and through the dimming circuit the amount of power delivered to the load.

FIG. 11*b* shows rotatable member 17A2 located alongside handle 16A. Rotatable member 17A2 is coupled to a rotary potentiometer (not shown). Adjustment of rotatable member 17A2, preferably using a thumb, varies the setting of the rotary potentiometer and through the dimming circuit the amount of power delivered to the load.

FIG. 11*c* includes rotatable member 17A3 (shown in phantom) accessible through opening 19 in toggle 16, by using a tool. Rotatable member 17A3 is only accessible when toggle 16 is in the up or ON position. Adjustment of rotatable member 17A3 using a tool varies the setting of the rotary potentiometer and through the dimming circuit the amount of power delivered to the load.

Figure 12:
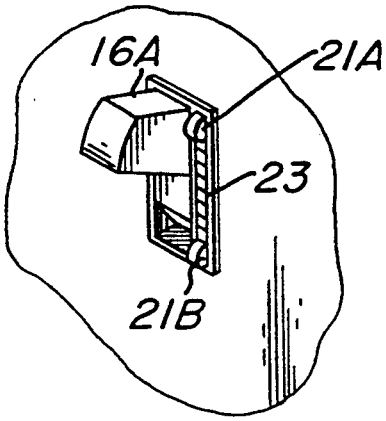
FIG. 12 shows an embodiment of the invention which includes raise and lower push buttons as dimmer circuit actuators.

Another embodiment of the invention is shown in FIG. 12. This embodiment includes the switch handle 16A of FIG. 1 to control the ON/OFF switching of the load. However, sliding member 18A has been replaced with push button actuators 21A and 21B and LED bar graph display 23. Depressing push button actuator 21A causes the amount of power supplied to the load to increase. In like fashion, depressing push button actuator 21B causes the amount of power supplied to the load to decrease. The amount of power being supplied to the load can be displayed using LED bar graph 23 in a known manner. A dimming circuit suitable for interfacing with push buttons 21A and 21B is disclosed in the *Signetics*, Philips professional analog IC handbook IC603-83, on page 235, using the *Signetics* TEA 1010 integrated circuit.

The present invention may be embodied in other specific forms without departing from the spirit or essential attributes thereof and, accordingly, reference should be made to the appended claims, rather than to the foregoing specification, as indicating the scope of the invention.

We claim:

1. A wallbox-mountable system for controlling electrical power to a load comprising, :

(a) a yoke having an opening located in correspondence with a central opening of a wallbox faceplate;

(b) a toggle switch which includes a handle, one end of said handle extending through said opening of said yoke and the other end of said handle mechanically coupled to means for turning power on and off to a load such that said handle is rotatable between a first position and a second position and snaps into said first and second positions at opposite extremes of its rotation causing said turn on and said turn off of said power to said load; and (c) at least one lever arm extending through and movable within said opening of said yoke, said at least one lever arm mechanically coupled to means for adjusting the amount of power supplied to said load.

2. The system according to claim 1, wherein said means for turning power on and off comprises a microswitch.

3. The system according to claim 1, wherein said means for adjusting power comprises a dimmer circuit.

4. The system according to claim 1, wherein said lever arm is of a type having a predetermined linear path of travel.

5. The system according to claim 4, wherein said lever arm is directly coupled to a linear potentiometer serving as a component of said means for adjusting power to said load.

6. The system according to claim 1, wherein said opening of said yoke has a height dimension of about 25 mm and a width dimension of about 12 mm.

7. The system according to claim 1, wherein said toggle switch and said at least one lever arm are arranged in a side-by-side relationship.

8. The system according to claim 1, wherein said toggle switch has an over-center spring bistable mechanism.

9. The system according to claim 1 further comprising a frame member occupying said opening in said yoke and surrounding said handle of said toggle switch, said frame member having at least one channel, said lever arm extending through and slidable within said channel.

10. The system according to claim 9 wherein the lever arm is of a type having a predetermined linear path of travel.

11. The system according to claim 1, wherein the width of said toggle switch handle is substantially greater than that of said at least one lever arm.

12. A system according to claim 9, wherein said at least one lever arm has a holding member that extends out of said opening and which serves as a means for holding said lever arm during movement of said lever arm.

13. A system according to claim 12, wherein said channel is partially formed by a wall which is adjacent to but does not interfere with said lever arm in its travel along its linear path, said wall having at least one protuberance located at one of the end regions of said linear path and having a height dimension which exceeds the height of said holding member of said lever arm.

14. A wallbox-mountable system according to claim 5, wherein said linear potentiometer includes detents at predetermined points along its travel which impede movement along said linear path of travel

15. A wallbox-mountable system according to claim 1, further comprising:

(a) a backcover connected to said yoke and housing said means for turning on and off said power and also housing said means for adjusting said power to said load as well as circuitry which accomplishes said adjustment.

16. A system according to claim 1, wherein said at least one lever arm comprises a first and a second lever arm.

17. A system according to claim 16, wherein said first lever arm is coupled to a means for adjusting the power supplied to a lighting load and said second lever arm is coupled to means for adjusting the speed of a motor.

18. The wallbox-mountable system for controlling electrical power to a load comprising, :

(a) a yoke having an opening;

(b) a three-way toggle switch which includes a handle, one end of said handle extending through said opening and the other end of said handle mechanically coupled to a single pole double throw switch for controlling the application of power to a load, said handle being mechanically coupled to said single pole double throw switch such that said handle is rotatable between a first position and a second position and snaps into said first and second position at opposite extremes of its rotation causing said single pole double throw switch to change state; and (c) at least one lever arm extending through and slidable within said opening, said at least one lever arm mechanically coupled to means for adjusting the amount of power supplied to said load.

19. The system according to claim 18, wherein said means for turning power on and off comprises a microswitch.

20. The system according to claim 18, wherein said means for adjusting power comprises a dimmer circuit.

21. The system according to claim 18, wherein said lever arm is of a type having a predetermined linear path of travel.

22. The system according to claim 21, wherein said lever arm is directly coupled to a linear potentiometer serving as a component of said means for adjusting power to said load.

23. The system according to claim 18, wherein said opening of said yoke has a height dimension of about 25 mm and a width dimension of about 12 mm.

24. The system according to claim 18, wherein said toggle switch and said at least one lever arm are arranged in a side-by-side relationship.

25. The system according to claim 18, wherein said toggle switch has an over-center spring bistable mechanism.

26. A wallbox-mountable system for controlling electrical power to a load comprising, :

(a) a yoke having an opening with dimensions corresponding to those of an opening of a wallbox faceplate;

(b) a frame completely occupying said opening of said yoke and having a channel providing a passageway for a tool for use with means for adjusting power to a load; and (c) a toggle switch which includes a handle, one end of said handle extending through said frame and the other end of said handle mechanically coupled to means for turning power on and off to a load such that said handle is rotatable between a first position and a second position and snaps into said first and second positions at opposite extremes of its rotation causing said turn on and said turn off of said power to said load.

27. A wallbox-mountable system for controlling electrical power to a load comprising, :

(a) a yoke having an opening with dimensions corresponding to those of an opening of a wallbox faceplate;

(b) a toggle switch which includes a handle, one end of said handle extending through said opening of said yoke and the other end of said handle mechanically coupled to means for turning power on and off to a load such that said handle is rotatable between a first position and a second position and snaps into said first and second positions at opposite extremes of its rotation causing said turn on and said turn off of said power to said load;

(c) at least one lever arm extending through and slidable within said opening of said yoke, said at least one lever arm mechanically coupled to means for adjusting the amount of power supplied to said load; and (d) removable cover means to cover said lever arm and prevent adjustment of said lever arm when said cover means is in place.

28. A wallbox-mountable system for controlling electrical power to first and second electrical loads, comprising:

(a) a yoke having an opening with dimensions corresponding to those of an opening of a wallbox faceplate;

(b) a toggle switch which includes a handle, one end of said handle extending through said opening of said yoke and the other end of said handle mechanically coupled to means for turning power on and off to at least one of said first and second loads, such that said handle is rotatable between a first position and a second position and snaps into said first and second positions at opposite extremes of its rotation causing said turn off and said turn off of said power to said at least one of said first and second loads;

(c) a first lever arm extending through and slidable within said opening of said yoke, said first lever arm mechanically coupled to first means for adjusting the amount of power supplied to said first load; and (d) a second lever arm extending through and slidable within said opening of said yoke, said second lever arm mechanically coupled to second means for adjusting the amount of power supplied to said second load.

29. The system according to claim 28, wherein said first load is a lighting load and said first means for adjusting power comprises a dimmer.

30. The system according to claim 28, wherein said second load is a motor and said second means for adjusting power comprises a motor speed control.

31. The system according to claim 29, wherein said second load is a motor and said second means for adjusting power comprises a motor speed control.

32. The system according to claim 31, wherein said dimmer comprises a potentiometer and said motor speed control comprises a potentiometer.

33. The system according to claim 31, wherein said dimmer comprises a potentiometer and said motor speed control comprises a multi-position switch.

34. A wallbox-mountable system for controlling electrical power to a load comprising, :

(a) a yoke having an opening with dimensions corresponding to those of an opening of a wallbox faceplate;

(b) a toggle switch means which includes a handle, one end of said handle extending through said opening of said yoke, and the other end of said handle mechanically coupled to means for turning power on and off to a load such that said handle is rotatable between a first position and a second position and snaps into said first and second positions at opposite extremes of its rotations causing said turn on and said turn off of said power to said load; and (c) an independent adjustment means, adjustable independently of said toggle switch means, comprising at least a first actuator extending through said opening of said yoke, said independent adjustment means coupled to means for adjusting the power supplied to said load.

35. The system according to claim 34 wherein said first actuator is a linearly moveable actuator.

36. The system according to claim 34 wherein said first actuator is a rotatable actuator.

37. The system according to claim 36 wherein said rotatable actuator is positioned on the end of said handle, which extends through said opening of said yoke.

38. The system according to claim 36 wherein said rotatable actuator is a thumbwheel actuator.

39. The system according to claim 36 wherein said rotatable actuator is concealed when said handle of said toggle switch means is in said off position.

40. The system according to claim 34 wherein said at least a first actuator comprises first and second pushbutton actuators.

41. The system according to claim 40 wherein pressing said first pushbutton actuator causes said power supplied to said load to increase and pressing said second pushbutton actuator causes said power supplied to said load to decrease.

42. The system according to claim 41 further comprising an LED bar graph display to show the amount of power being supplied to the load.

43. The system according to claim 34 wherein said independent adjustment means adjusts the maximum amount of power supplied to said load.

44. A wallbox mountable system for controlling electrical power to a load comprising:

(a) a faceplate having an opening substantially about 0.406 inches wide by substantially about 0.925 inches high;

(b) a toggle switch which includes a handle, one end of said handle extending through said opening of said faceplate, and the other end of said handle coupled to means for turning power on and off to a load such that said handle is rotatable between a first position and a second position and snaps into said first and second positions at opposite extremes of its rotation causing said turn on and said turn off of said power to said load; and (c) at least one lever arm extending through said opening of said faceplate, said at least one lever arm coupled to means for adjusting the amount of power supplied to said load.

45. The system according to claim 44, wherein said at least one lever arm comprises first and second lever arms.

46. A wallbox mountable system for controlling electrical power to a load, comprising:

(a) a yoke having an opening with dimensions corresponding to those of an opening of a wallbox faceplate;

(b) a toggle switch which includes a handle, one end of said handle extending through said opening of said yoke, and movable in a vertical direction within said opening and the other end of said handle mechanically coupled to means for turning power on and off to a load such that said vertically movable handle is rotatable between an up position and a down position and snaps into said up and down positions at opposite extremes of its rotation causing said turn on and said turn off of said power to said load; and (c) at least one lever arm extending through and slidable in a vertical direction within said opening of said yoke, said at least one lever arm mechanically coupled to means for adjusting the amount of power supplied to said load.

47. The system according to claim 45, wherein said at least one lever arm comprises first and second lever arms.

* * * * *